US010865074B2

(12) United States Patent
Cai et al.

(10) Patent No.: US 10,865,074 B2
(45) Date of Patent: Dec. 15, 2020

(54) HANDRAIL AUTOMATICALLY TENSIONING SYSTEM AND A METHOD FOR ADJUSTING TENSION LEVEL OF HANDRAIL

(71) Applicant: Otis Elevator Company, Farmington, CT (US)

(72) Inventors: QingXi Cai, Zhejiang (CN); JianGuo Li, Zhejiang (CN); Xin Wei, Zhejiang (CN); Jie Hu, Zhejiang (CN); LiFei Cheng, Zhejiang (CN); ZuAn Tang, Guangde (CN); Jun Ma, Zhejiang (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/573,042

(22) Filed: Sep. 17, 2019

(65) Prior Publication Data

US 2020/0087116 A1 Mar. 19, 2020

(30) Foreign Application Priority Data

Sep. 19, 2018 (CN) ..... 2018 1 1092459

(51) Int. Cl.
*B66B 23/20* (2006.01)
*B66B 21/02* (2006.01)
(Continued)

(52) U.S. Cl.
CPC ..... *B66B 23/20* (2013.01); *B66B 21/02* (2013.01); *B66B 23/24* (2013.01); *B66B 25/003* (2013.01); *B66B 25/006* (2013.01); *B66B 31/02* (2013.01)

(58) Field of Classification Search
CPC ..... B66B 23/20; B66B 21/02; B66B 25/006; B66B 25/003; B66B 23/24; B66B 31/02; B65G 23/44
(Continued)

(56) References Cited

U.S. PATENT DOCUMENTS 3,675,482 A * 7/1972 Hewitt ..... G01L 5/04 198/810.04
4,564,099 A * 1/1986 Uozumi ..... B66B 29/005 198/323
(Continued)

FOREIGN PATENT DOCUMENTS

CN 204897131 U 12/2005
CN 203497908 U 3/2014
(Continued)

OTHER PUBLICATIONS

European Search Report for application EP 19198442.6, dated Apr. 3, 2020, 91 pages.

*Primary Examiner* — James R Bidwell
(74) *Attorney, Agent, or Firm* — Cantor Colburn LLP

(57) ABSTRACT

An automatic handrail tensioning system and a method for adjusting the tension degree of a handrail, and belongs to the technical field of escalators. The automatic handrail tensioning system of the present invention comprises: a sensor for detecting information that can reflect a tension degree of the handrail; a controller for determining the tension degree information of the handrail according to the information detected by the sensor, and generating a corresponding control instruction for adjusting the tension degree of the handrail based on the tension degree information; and an actuator for driving a tensioning device to adjust the tension degree of the handrail based on the control instruction.

20 Claims, 3 Drawing Sheets

(51) Int. Cl.
*B66B 25/00* (2006.01)
*B66B 31/02* (2006.01)
*B66B 23/24* (2006.01)

(58) Field of Classification Search
USPC ..... 198/336, 810.04
See application file for complete search history.

(56) References Cited

U.S. PATENT DOCUMENTS 5,072,820 A * 12/1991 Steffen ..... B66B 29/005 198/323
5,092,446 A * 3/1992 Sullivan, Jr. ..... B66B 29/04 198/323
5,188,209 A 2/1993 Johnson et al.
6,131,727 A * 10/2000 Nelson ..... B65G 43/02 198/810.02
6,460,679 B1 * 10/2002 Stuffel ..... B66B 23/20 198/336
2016/0016760 A1 * 1/2016 Srb-Gaffron ..... B66B 23/20 198/336
2018/0029833 A1 2/2018 Hu et al.

FOREIGN PATENT DOCUMENTS

CN 104961029 A 10/2015
CN 105417336 A 3/2016
CN 205170135 U 4/2016
CN 205222419 U 5/2016
CN 205241031 U 5/2016
CN 206033004 U 3/2017
CN 205855744 U 4/2017
CN 107662871 A 2/2018
CN 107826953 A 3/2018
EP 0960847 A1 12/1999
JP H0537861 U 5/1993
JP H07137975 A 5/1995
JP 2006008388 A 1/2006
JP 2010143676 A 7/2010
JP 6176872 B1 8/2017

* cited by examiner

HANDRAIL AUTOMATICALLY TENSIONING SYSTEM AND A METHOD FOR ADJUSTING TENSION LEVEL OF HANDRAIL

CROSS-REFERENCE TO RELATED APPLICATION

This application claims priority from Chinese patent application No. 201811092459.3, filed on Sep. 19, 2018, the entirety of which is hereby incorporated by reference herein and forms a part of the specification.

FIELD OF THE INVENTION

The invention belongs to the technical field of Escalator, and relates to tension control of a handrail, in particular to an automatic handrail tensioning system, a method for adjusting the tension degree of a handrail, and an escalator system using the automatic handrail tensioning system.

BACKGROUND OF THE INVENTION

Handrails are generally used in escalators (including moving walk), routine maintenance of escalators typically involves maintenance operations for the handrail, including tension adjustments to the handrail to avoid various problems resulting from the handrail, for example, heat, increased wearing etc. caused by the handrail being too tight, and safety problems such as hand clamping, speed of handrail and steps and the like resulted from the handrail being too loose.

However, the maintenance operation relating to the tension adjustment of the handrail is typically done manually, which not only involves heavy workload, being time consuming and laborious, but is also difficult to achieve accurate adjustment of tension and has high experience requirement on maintenance workers.

SUMMARY OF THE INVENTION

It is an object of the present invention to achieve automatic adjustment of the tension degree of the handrail of the escalator system.

It is a further object of the present invention to achieve a timely and/or accurate adjustment of the tension degree of the handrail of the escalator system.

To the accomplishment of the foregoing or other purposes, the invention provides the following technical solution.

In accordance with a first aspect of the present invention, there is provided an automatic handrail tensioning system, comprising: a sensor for detecting information that can reflect a tension degree of the handrail; a controller determining tension degree information of the handrail according to the information detected by the sensor, and generating a corresponding control instruction for adjusting the tension degree of the handrail based on the tension degree information; and an actuator for driving a tensioning device to adjust the tension degree of the handrail based on the control instruction.

The automatic handrail tensioning system according to an embodiment of the present invention, wherein the sensor comprises a pressure sensor, the information detected by the pressure sensor being a pressure value corresponding to a tension of the handrail.

The automatic handrail tensioning system according to another embodiment or any embodiment of the present invention, wherein the pressure sensor comprises a first pressure sensor and/or a second pressure sensor; wherein the first pressure sensor is mounted between a first end revolution chain and the handrail guideway of the escalator, and/or the second pressure sensor is mounted between a second end revolution chain and the handrail guideway of the escalator.

The automatic handrail tensioning system according to another embodiment or any embodiment of the present invention, wherein the pressure sensor comprises a first pressure sensor and/or a second pressure sensor; wherein the first pressure sensor is mounted on a bearing pedestal of a wheel of the first end revolution chain and/or the second pressure sensor is mounted on a bearing pedestal of a wheel of a second end revolution chain.

The automatic handrail tensioning system according to another embodiment or any embodiment of the present invention, wherein the controller is further used for determining the tension degree information of the tension degree of the handrail being substantially normal when the pressure value is greater than or equal to a first predetermined pressure value and less than or equal to a second predetermined pressure value, determining the tension degree information of the tension degree of the handrail being too tight when the pressure value is greater than the second predetermined pressure value, and determining the tension degree information of the tension degree of the handrail being too loose when the pressure value is less than the first predetermined pressure value.

The automatic handrail tensioning system according to another embodiment or any embodiment of the present invention, wherein the controller is further used to quantitatively determine the tension degree information of the handrail based on the pressure value, and to generate the corresponding control instruction for quantitatively adjusting the tension degree of the handrail based on a quantitative tension degree information.

The automatic handrail tensioning system according to another embodiment or any embodiment of the present invention, wherein the sensor comprises a temperature sensor for detecting temperature information of the handrail.

The automatic handrail tensioning system according to another embodiment or any embodiment of the present invention, the controller is further used to determine the tension degree information of the tension degree of the handrail being too tight when the temperature information is greater than or equal to a predetermined temperature threshold.

The automatic handrail tensioning system according to another embodiment or any embodiment of the present invention, wherein the sensor comprises a ranging sensor for detecting spacing information between the handrail and the handrail guideway.

The automatic handrail tensioning system according to another embodiment or any embodiment of the present invention, wherein the controller is further used to determine the tension degree information of the tension degree of the handrail being too tight when the spacing information is greater than or equal to a predetermined spacing threshold.

The automatic handrail tensioning system according to another embodiment or any embodiment of the present invention, wherein the ranging sensor is mounted below the handrail corresponding to an upper corner part of the escalator.

The automatic handrail tensioning system according to another embodiment or any embodiment of the present invention, further comprising the tensioning device, wherein the tensioning device comprises: a body; wheels acting on an adjusted handrail; main screw rod substantially perpendicular to the adjusted handrail; an upper platen; a lower platen substantially parallel to the upper platen; and a compression elastomer between the upper platen and the lower platen; wherein the main screw rod is connected with a output end of the actuator, when the main screw rod is driven by the actuator to rotate in a first direction/second direction, the upper platen is driven to move upwards/downwards along the main screw rod, thus the lower platen is driven by the compression elastomer to move upwards/downwards, and the lower platen drives the wheel to release/increase the tension of the handrail.

The automatic handrail tensioning system according to another embodiment or any embodiment of the present invention, further comprising: a pair of linear guides secured on the body and substantially perpendicular to the adjusted handrail, wherein the main screw rod is positioned between the pair of linear guides, the lower platen being movable upwards/downwards along the pair of linear guides.

The automatic handrail tensioning system according to another embodiment or any embodiment of the present invention, further comprising a fixed bracket secured on the body for securing a lower end of the main screw rod and the actuator.

The automatic handrail tensioning system according to another embodiment or any embodiment of the present invention, wherein the sensor comprises a pressure sensor, the information detected by the pressure sensor being a pressure value corresponding to a tension of the handrail; wherein the pressure sensor is mounted between the upper platen and the lower platen to detect a pressure value produced by the compression elastomer.

In accordance with a second aspect of the present invention, there is provided a method of adjusting the tension degree of a handrail, comprising the steps of: detecting information that can reflect the tension degree of the handrail; determining tension degree information of the handrail according to the detected information; generating a corresponding control instruction for adjusting the tension degree of the handrail based on the tension degree information; and driving a tensioning device to adjust the tension degree of the handrail based on the control instruction.

The method according to an embodiment of the present invention, wherein the detected information comprises a pressure value corresponding to a tension of the handrail.

The method according to another embodiment or any embodiment of the present invention, wherein in the step of determining the tension degree information: determining the tension degree information of the tension degree of the handrail being substantially normal when the pressure value is greater than or equal to a first predetermined pressure value and less than or equal to a second predetermined pressure value, determining the tension degree information of the tension degree of the handrail being too tight when the pressure value is greater than the second predetermined pressure value, and determining the tension degree information of the tension degree of the handrail being too loose when the pressure value is less than the first predetermined pressure value.

The method according to another embodiment or any embodiment of the present invention, wherein in the step of determining the tension degree information: quantitatively determining the tension degree information of the handrail according to the pressure value; in the step of generating a control instruction: generating a corresponding control instruction for quantitatively adjusting the tension degree of the handrail based on the quantitative tension degree information.

The method according to another embodiment or any embodiment of the present invention, wherein the detected information comprises temperature information of the handrail; in the step of determining the tension degree information: determining the tension degree information of the tension degree of the handrail being too tight when the temperature information is greater than or equal to a predetermined temperature threshold.

The method according to another embodiment or any embodiment of the present invention, wherein the detected information comprises spacing information between the handrail and a handrail guideway; in the step of determining the tension degree information: determining the tension degree information of the tension degree of the handrail being too tight when the spacing information is greater than or equal to a predetermined spacing threshold.

In accordance with a third aspect of the present invention, there is provided an escalator system, comprising a handrail, and any one of the automatic handrail tensioning systems described above.

The above features and operations of the present invention will become more apparent from the following description and the accompanying drawings.

BRIEF DESCRIPTION OF THE DRAWINGS

The above and other objects and advantages of the present invention will become more complete and clear from the following detailed description taken in conjunction with the drawings, wherein like or similar elements are designated by like numerals.

DETAILED DESCRIPTION OF THE EMBODIMENT(S) OF THE INVENTION

For the sake of brevity and illustrative purposes, the principles of the invention are described herein primarily with reference to exemplary embodiments thereof. However, those skilled in the art will readily recognize that the same principles are equally applicable to all types of automatic handrail tensioning systems and/or methods for the adjustment of the tension degree of handrails, and that these same principles may be implemented therein without departing from the true spirit and scope of this patent application. Moreover, in the following description, reference is made to the accompanying drawings, which illustrate specific exemplary embodiments. Electrical, mechanical, logical, or structural alternations may be made to these embodiments without departing from the spirit and scope of the invention. In addition, while the features of the invention are disclosed in connection with several embodiments/only one of the embodiments, as may be desired and/or advantageous for any given or identifiable function, this feature may be combined with other embodiments/one or more other features of the embodiments. The following description is, therefore, not to be taken in a limiting sense, and the scope of the present invention is defined by the appended claims and their equivalents.

In this context, an escalator system includes an escalator system that enables passenger transport between different floors and an automated Moving Walk that enables passenger transport on the same floor.

Figure 1:
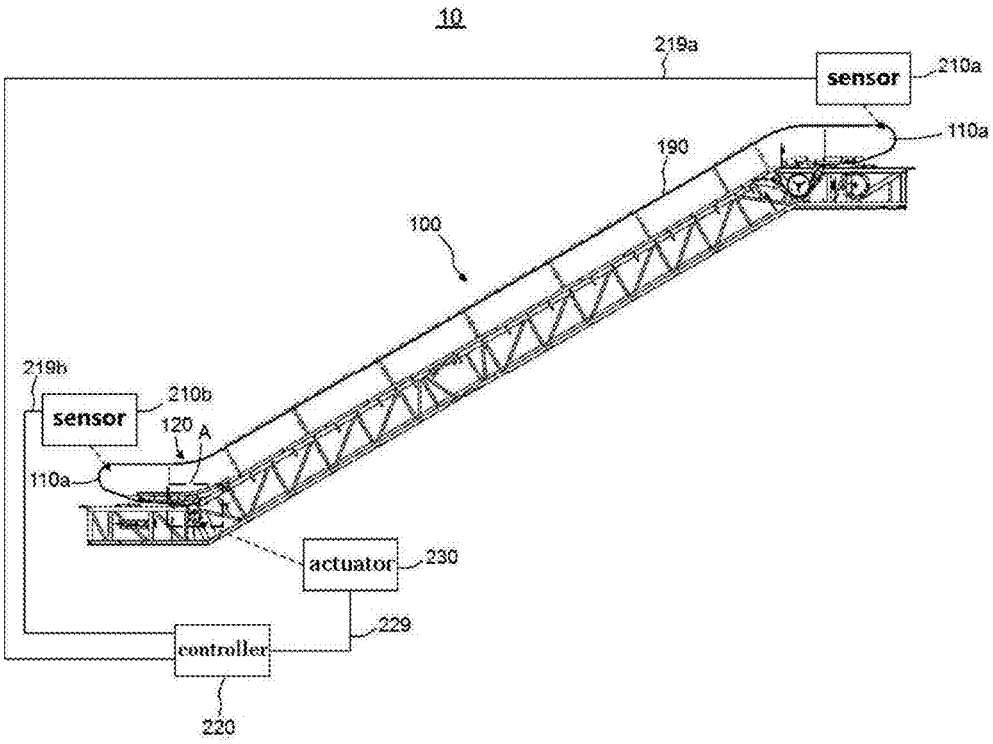
FIG. 1 is a schematic view of an escalator system in accordance with an embodiment of the present invention in which an automatic handrail tensioning system of an embodiment of the present invention is used.
Figure 2:
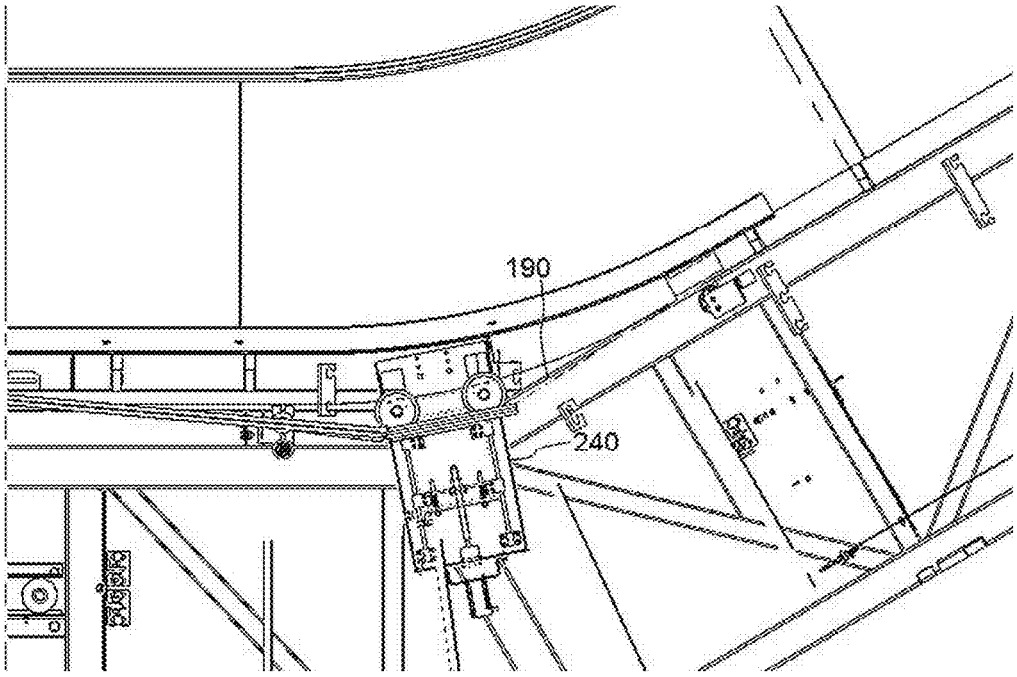
FIG. 2 is an enlarged view of the area A in FIG. 1.
Figure 3:
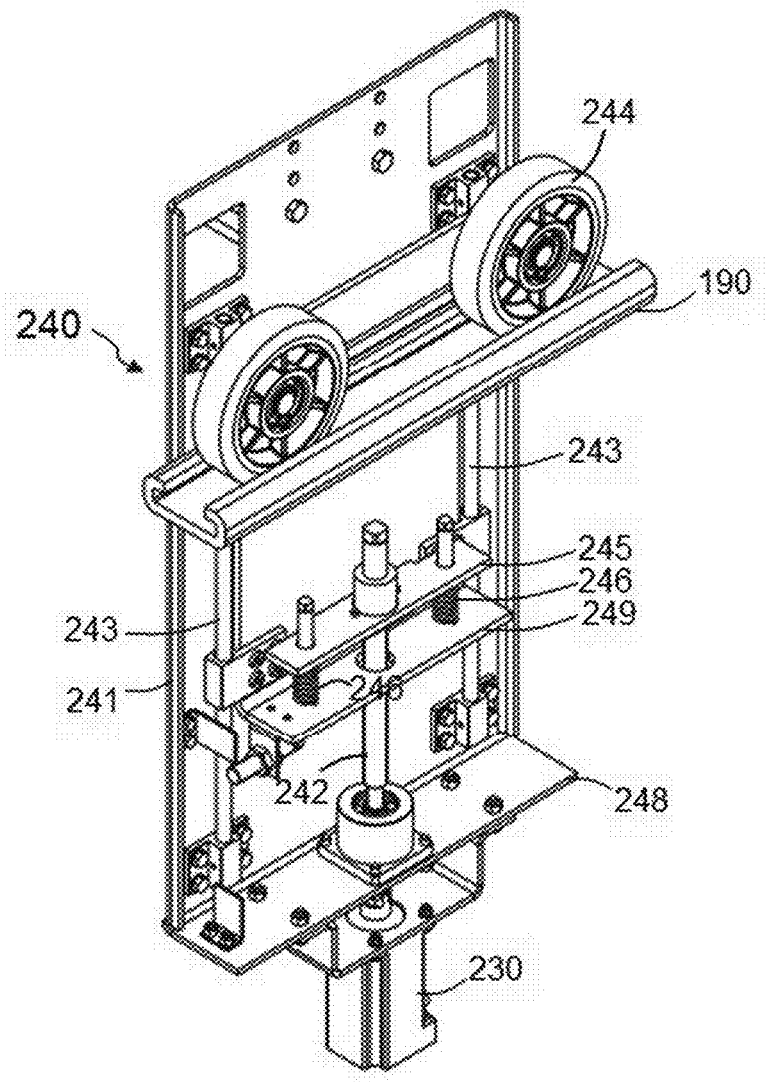
FIG. 3 is a perspective schematic view of a tensioning device of the automatic handrail tensioning system in accordance with an embodiment of the present invention.

FIG. 1 is a schematic view of an escalator system according to an embodiment of the present invention in which an automatic handrail tensioning system according to an embodiment of the present invention is used; FIG. 2 is an enlarged view of the area A in FIG. 1; FIG. 3 is a perspective schematic view of a tensioning device of an automatic handrail tensioning system according to an embodiment of the present invention. An automatic handrail tensioning system of an embodiment of the present disclosure and an escalator system 10 using the automatic handrail tensioning system are illustrated below in conjunction with FIGS. 1-3.

As shown in FIG. 1, the escalator system 10 includes an escalator 100 on which a handrail 190 is configured. In one embodiment, the handrail 190 may be mounted on a handrail guideway (not shown), and there are ends 110*a* and 110*b* at two ends of the elevator 100 respectively for effecting revolution of the handrail 190. Disposed at the ends 110*a* and 110*b* are end revolution chains respectively (not shown), the wheels on which may roll on the handrail guideway. Also, the handrail 190 is pressed against the wheels on the end revolution chain and, as a result, the tension of the handrail 190 may be passed to and reflected on the corresponding components of the end revolution chain. It will be appreciated that the tension of the handrail 190 corresponds to its tension degree, i.e., the tension being too great corresponds to the tension degree being too tight, and the tension being too small corresponds to the tension degree being too loose.

Continuing with FIG. 1, the escalator system 10 includes one or more sensors 210 (e.g., sensors 201*a* and 210*b*) for detecting information 219 that can reflect the tension degree of the handrail. The information 219 may be sent to the controller 220 in a wired manner, for example.

Continuing with FIG. 1, the escalator system 10 further includes a controller 220 for determining the tension degree information of the handrail 190 based on the information 219 detected by the sensors 210, and generating a corresponding control instruction 229 for adjusting the tension degree of the handrail 190 based on the tension degree information. For example, a control instruction 229 for reducing the tension of the handrail 190 is generated if the tension degree is too tight, whereas a control instruction 229 for increasing the tension of the handrail 190 is generated. In particular, the controller 220 may be implemented by a device with computing processing function, such as implemented by a processor, a microcontroller, a programmable data processing apparatus, or the like. Note that in disposing a plurality of sensors 210, the information 219 corresponds to information detected by the plurality of sensors, and the controller 220 may perform corresponding data processing in advance to the information 219 of the plurality of sensors 210, e.g., data averaging processing, filtering processing, and the like.

Continuing with FIG. 1, the escalator system 10 further includes an actuator 230 for driving a tensioning device 240 to adjust the tension degree of the handrail 190 based on the control instruction 229. The actuator 230 may particularly be, for example and not limited to, a motor (e.g., a micro stepper motor), according to the type of which the particular form of the control instruction 229 may be determined.

Continuing with FIGS. 1 and 2, the escalator system 10 further includes a tensioning device 240 disposed corresponding to the handrail 190, which is an operator that adjusts the tension degree of the handrail 190. In this embodiment, the tensioning device 240 may be automatically performed by the actuation of the actuator 230, which may not require manual adjustment. In an embodiment, the tensioning device 240 may be, but is not limited to, being mounted in the area A as shown in FIG. 1.

In an embodiment, the sensor 210 may be or include a pressure sensor 210, and the information 219 detected by the pressure sensor may accordingly be or include a pressure value F corresponding to the tension of the handrail 190. Through the detection of the pressure value F, the tension or tension degree of the handrail 190 can be accurately and timely reflected.

As shown in FIG. 1, to detect a pressure value F that can relatively accurately reflect the tension or tension degree of the handrail 190, the pressure sensor 210 may be disposed at the end 110*a* and/or the end 110*b* of the escalator 100, i.e., the pressure sensor 210 includes a pressure sensor 210*a* disposed at the end 110*a* and/or a pressure sensor 210*b* disposed at the end 110*b*. Pressure sensor 210*a* is mounted between an end revolution chain of the end 110*a* of the escalator 100 and a handrail guideway (e.g., mounted on one side of the handrail guideway facing the end revolution chain), and pressure sensor 210*b* is mounted between the end revolution chain of the end 110*b* of the escalator 100 and the handrail guideway (e.g., mounted on one side of the handrail guideway facing the end revolution chain). During operation of the escalator 100, the greater the tension of the handrail 190, the greater the pressure applied to the end revolution chains at the end 110 of the handrail 190, and thus the greater the pressure sensed by the pressure sensor 210 of the end revolution chain and the handrail guideway, the greater the pressure value F detected by the pressure sensor 210. Conversely, the pressure value F detected by the pressure sensor 210 will be less.

It should be noted that the pressure sensor 210*a* or 210*b* may be a plurality of pressure sensors 210*a* or 210*b*, for example, they may be separately disposed at different positions of the end revolution chains, and the pressure value F detected by each pressure sensor may be individually used to determine the tension degree and also the tension degree may be synthetically determined based on the pressure values F of the plurality of pressure sensors, e.g., the pressure values F may be used to determine the tension degree after averaging processing.

For ease of installation and accurate detection, the pressure sensor 210 between the end revolution chain and the handrail guideway, for example, may be selected as a sheet pressure sensor.

The mounting position of the pressure sensor 210 is not limited to the above example, and in yet another embodiment, the pressure sensor 210*a* may be mounted on a bearing pedestal of a wheel of the end revolution chain of the end 110*a*, and the pressure sensor 210*b* may be mounted on a bearing pedestal of a wheel of the end revolution chain of the end portion 110*b*. Accordingly, the pressure sensor 210 may be specifically selected as a shaft-like pressure sensor. During the operation of the escalator 100, the greater the tension of the handrail 190, the greater the pressure applied to the wheels of the end revolution chains by the end 110 of handrail 190, thus the greater the pressure between the wheels of the end revolution chains and its bearing pedestal, the greater the pressure value F detected by the pressure sensor 210. Conversely, the pressure value F detected by the pressure sensor 210 will be less.

Where the pressure value F is detected using the pressure sensor 210, in an embodiment, the controller 220 is also configured to determine that the tension degree of the handrail 190 is substantially normal when the pressure value F is greater than or equal to a first predetermined pressure value $F_1$ and less than or equal to a second predetermined pressure value $F_2(F_2>F_1)$, and to determine that the tension degree of the handrail 190 is too tight when the pressure value F is greater than the second predetermined pressure value $F_2$, and to determine that the tension degree of the handrail 190 is too loose when the pressure value F is less than the first predetermined pressure value $F_1$. In this way, it may be determined qualitatively based on the pressure value F whether the tension degree of the handrail 190 is too tight, too loose, or normal.

Wherein the first predetermined pressure value $F_1$ and the second predetermined pressure value $F_2$ may be obtained in advance by testing under different known tension degree information. Different first predetermined pressure values $F_1$ or second predetermined pressure values $F_2$ may be preset corresponding to different pressure sensors (e.g., different pressure sensors mounted in different positions).

In yet another embodiment, to more accurately determine the tension degree information, the controller 220 is also configured to quantitatively determine the tension degree information of the handrail 190 according to the pressure value F, and to generate a corresponding instruction for quantitatively adjusting the tension degree of the handrail 190 based on the quantitative tension degree information. Specifically, a relationship or relation curve between the pressure value F and the tension of the handrail 190 may be stored in the controller 220 so that the magnitude of the tension may be quantitatively calculated or estimated based on the pressure value F. In this way, the tension degree may be adjusted quantitatively, for example, the tension of the handrail 190 may be maintained at a certain ideal value or some ideal range such that the operating conditions of the escalator are more ideal.

The controller 220 of the above example may be implemented by a tension degree determining unit and an instruction generating unit, the tension degree determining unit may determine the tension degree information of the handrail 190 based on the information 219 detected by the sensor, and the instruction generating unit may generate a corresponding control instruction 229 for adjusting the tension degree of the handrail 190 based on the tension degree information.

It is noted that the sensor 210 is not limited to a pressure sensor, instead other types of sensors may alternatively or additionally be used to detect the handrail 190. In an embodiment, a temperature sensor may be used alone or in conjunction with a pressure sensor or the like as the sensor 210, the temperature sensor is used to detect the temperature information T of the handrail 190. The temperature sensor may be mounted in a position sensitive to the tension of the handrail 190 and easy to warming as the tension is too large.

Correspondingly, the controller 220 may also determine that the tension degree of the handrail 190 is too tight when the temperature information T is greater than or equal to the predetermined temperature threshold $T_{th}$. Wherein the predetermined temperature threshold $T_{th}$ may be determined by pre-detecting a temperature value corresponding to the tension degree being too tight.

It will be appreciated that the temperature sensor may be used in conjunction with a pressure sensor, for example in the event that a pressure sensor fails or fails to accurately detect, the tension degree being too tight may be determined at least by the temperature information T detected by the temperature sensor, avoiding damage to associated components when fail to timely detect the tension degree being too tight.

In yet another embodiment, a ranging sensor may be used alone or in conjunction with a pressure sensor or the like as the sensor 210, the ranging sensor is used to detect spacing information D between the handrail 190 and the handrail guideway. The ranging sensor may be particularly but not limited to being mounted below the handrail 190 of the upper corner part 120 of the corresponding escalator 110 (shown in FIG. 1) because the spacing between the handrail 190 and the handrail guideway corresponding to the upper corner part 120 can vary more sensitively due to the change in tension of the handrail 190. Accordingly, the controller 220 may determine that the tension degree of the handrail 190 is too tight when the spacing information D is greater than or equal to the predetermined spacing threshold $D_{th}$. Wherein the predetermined spacing threshold $D_{th}$ may be determined by pre-detecting a distance value corresponding to the tension degree being too tight.

It will be appreciated that the ranging sensor may be used in conjunction with the pressure sensor, for example, in the event that the pressure sensor fails or fails to detect, the state that the tension degree being too tight may be determined at least by the spacing information D detected by the ranging sensor, avoiding damage to associated components when fail to timely detect the tension degree being too tight.

Continuing with FIGS. 2 and 3, in one embodiment, the tensioning device 240 includes a body 241, a wheel 244 acting on the adjusted handrail 190, a main screw rod 242 substantially perpendicular to the adjusted handrail 190, an upper platen 245 and a lower platen 249 disposed substantially parallel to each other, a compression elastomer 246 located between the upper platen 245 and the lower platen 249. The lower platen 249 and the wheel 244 are connected by a connection plate, which may be a linkage. The compression elastomer 246 may be a spring, it may also be two springs distributed across the main screw rod 242 on the left and right respectively, and rotation of the main screw rod 242 may be translated into movement of the upper platen 245 in the up-down direction shown in FIG. 3, thereby producing change in the compression of the compression elastomer 246.

Specifically, the tensioning device 240 further includes a pair of linear guides 243 secured to the body 241 and substantially perpendicular to the handrail 190, wherein the main screw rod 242 is located between the pair of linear guides 243, e.g., at a center position of the pair of linear guides 243 and disposed parallel thereto. The lower platen 249 is movable upwards or downwards along the pair of linear guides 243. In this way, the position of the lower platen 249 is more accurate, and more accurate adjustment can be achieved.

The tensioning device 240 also has a fixed bracket 248 secured to the body 241 for securing the lower end of the main screw rod 242 and the actuator 230. An output end of the actuator 230 (e.g. the output shaft of a motor) may enable the connection with the lower end of the fixed main screw rod 242 on the fixed bracket 248, for example, such that the main screw rod 242 may be fixed and be driven by the actuator 230 to rotate.

As the main screw rod 242 is driven (e.g., based on the driving output by the generated adjustment instruction) by the actuator 230 to rotate in a first direction, the upper platen 245 is driven to move upwards along the main screw rod 245, the compression elastomer 246 releases a portion of the pressure, which in turn causes the lower platen 249 to move upwards by the compression elastomer 246, and correspondingly, the lower platen 249 drives the wheel 244 to move upwards, releasing the tension of the handrail 190.

As the main screw rod 242 is driven by the actuator 230 to rotate in a second direction, the upper platen 245 is driven to move downwards along the main screw rod 242, the compression elastomer 246 is further compressed, which in turn pushes the lower platen 249 to move downwards by the compression elastomer 246, and the lower platen 249 drives the wheel 244 to act downwards on the handrail 190, thereby increasing the tension of the handrail 190.

The tensioning device 240 of the above example may accurately perform the output of the actuator 220 and facilitate accurate adjustment of the handrail 190.

It will be appreciated that when the tensioning device 240 is in the rest state, i.e., not driven by the actuator 230, the tension of the handrail 190 may be passed to the lower platen 249 by, for example, two wheels 244, which in turn is reflected at the pressure of the compression elastomer 246. That is, the tension of the handrail 190 may, to some degree, be fed back by the pressure of the compression elastomer 246. Thus, in an embodiment, the pressure sensor 210 may also be mounted between the upper platen 245 and the lower platen 249 to detect a pressure value F produced by the compressed elastomer 246, e.g., the pressure sensor 210 may be an annular pressure sensor that is nested with the compression elastomer 246 on the same positioning rod and located between the lower end of compression elastomer 246 and the lower platen 249 so that the lower pressure of compressed elastomer 246 may be accurately detected.

It is noted that according to the accuracy requirement of the detection, mounting location of the pressure sensor 210 may be a plurality of combinations of the various mounting locations of the above embodiments, i.e., different pressure sensors 210 may be mounted in different mounting locations of the above embodiments.

It is noted that the process of adjusting the tension degree of the handrail 190 may be a continuous process, illustratively, a process that continuously generate control instructions 229 for further enabling reasonable adjustment through the information 219 fed back by the sensor 210, thus continuously adjusting the tension degree or tension of the handrail 190 to a predetermined value or to a predetermined range.

The automatic handrail tensioning system according to the above embodiment can not only accurately determine in real time the current tension degree of the handrail 190, but also automatically adjust the tension degree of the handrail 190, thus no manual maintenance is needed, and maintenance operation of the escalator system 10 is greatly reduced. Moreover, the tension of the handrail 190 may be timely and accurately adjusted to a reasonable section, avoiding operating in the condition of too tight or too loose, thereby ensuring the operating condition and long lifetime of the handrail 190 and good safety in operation of the escalator system 10.

Figure 4:
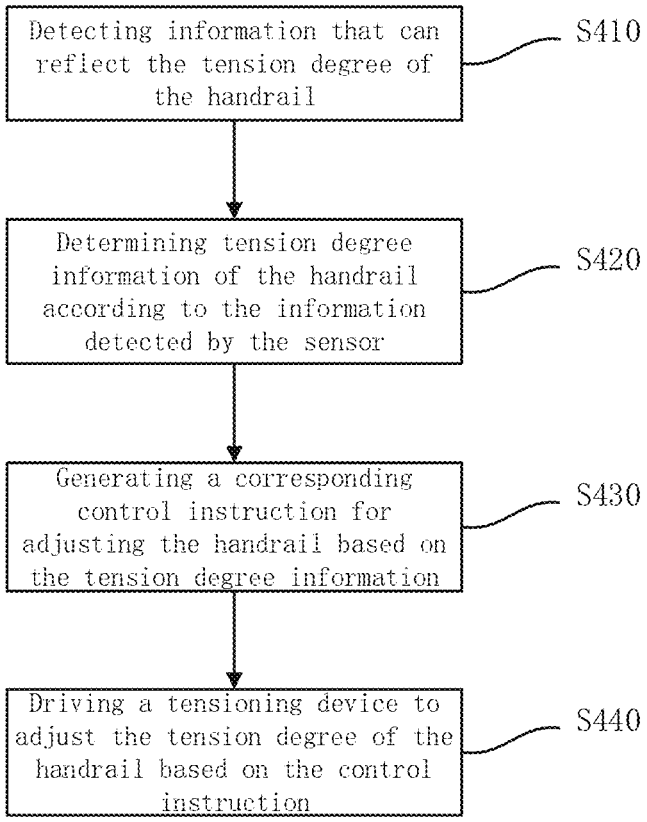
FIG. 4 is a method for adjusting the tension degree of a handrail in accordance with an embodiment of the present invention.

FIG. 4 illustrates a method for adjusting the tension degree of a handrail in accordance with an embodiment of the present invention. The main process of this method is illustrated below in conjunction with FIGS. 1, 3, and 4.

In step S410, information that can reflect the tension degree of the handrail is detected.

In this step, the information reflecting the tension degree of the handrail 190 includes a pressure value F corresponding to the tension of the handrail 190, which may be detected by the pressure sensor 210 of the above example. Of course, it may also include temperature information T of the handrail 190 and/or spacing information D between the handrail 190 and the handrail guideway, the temperature information T may be acquired by the temperature sensor detection, and the spacing information D may be acquired by, for example, a ranging sensor mounted below the handrail 190 of the upper corner part 120 of the corresponding escalator 110.

In step S420, the tension degree information of the handrail is determined according to the information detected by the sensor.

In an embodiment, the tension degree may be qualitatively determined, the tension degree of the handrail 190 is determined to be substantially normal when the detected pressure value F is greater than or equal to a first predetermined pressure value $F_1$ and less than or equal to a second predetermined pressure value $F_2(F_2>F_1)$, the tension degree of the handrail 190 is determined to be too tight when the pressure value F is greater than the second predetermined pressure value $F_2$, and the tension degree of the handrail 190 is determined to be too loose when the pressure value F is less than the first predetermined pressure value $F_1$.

In yet another embodiment, the tension degree may be determined quantitatively, i.e., the tension degree information of the handrail 190 is determined quantitatively from the detected pressure value F.

In this step S420, the tension degree of the handrail 190 may also be determined to be too tight when the detected temperature information T is greater than or equal to the predetermined temperature threshold $T_{th}$. Wherein the predetermined temperature threshold $T_{th}$ may be determined by pre-detecting a temperature value corresponding to the tension degree being too tight.

In this step S420, the tension degree of the handrail 190 being too tight may also be determined when the detected spacing information D is greater than or equal to the predetermined spacing threshold $D_{th}$. Wherein the predetermined spacing threshold $D_{th}$ may be determined by pre-detecting a distance value corresponding to the tension degree being too tight.

In step S430, corresponding instructions for adjusting the tension degree of the handrail is generated based on the tension degree information. In this step, where the current tension degree information has been determined, a corresponding amount of adjustment may be determined such that a corresponding control instruction 229 may be generated, which may be output to the actuator 230 and used to drive the tensioning device 240.

In step S440, the tensioning device 240 is driven to adjust the tension degree of the handrail based on the control instructions 229.

In this step, the actuator 230 operates based on the instruction 240, the output shaft of which drives tensioning device 240 to adjust the tension degree of the handrail 190. Illustratively, the actuator 230 drives the main screw rod 242 to rotate in a first direction, driving the upper platen 245 to move upwards along the main screw rod 242, the compression elastomer 246 releases a portion of the pressure, which in turn causes the lower platen 249 to move upwards by the compression elastomer 246, and correspondingly, the lower platen 249 drives the wheel 244 to move upwards, releasing the tension of the handrail 190, in this way a state of the tension degree being too tight is able to be adjusted to a state of the tension degree being normal. Actuator 230 drives the main screw rod 242 to rotate in a second direction to drive the upper platen 245 to move downwards along the main screw rod 242, the compression elastomer 246 is further compressed, which in turn pushes the lower platen 249 to move downwards by the compression elastomer 246, and the lower platen 249 drives the wheel 244 to act downwards on the handrail 190, thereby increasing the tension of the handrail 190, in this way a state of the tension degree being too loose is able to be adjusted to a state of the tension degree being normal.

It should be noted that the process of above example control method may be repeatedly performed, and may even be repeatedly performed during one adjustment process to precisely adjust the tension of the handrail 190 to a predetermined value or a predetermined range.

The above examples primarily illustrate an automatic handrail tensioning system, an escalator system, and a method for adjusting the tension degree of the handrail of the present invention. While only some of the embodiments of the present invention have been described, it will be understood by those of ordinary skill in the art that the present invention may be implemented in many other forms without departing from its spirit and scope. Accordingly, the illustrated examples and implementations are to be taken as illustrative and not restrictive, and the invention may encompass various modifications and substitutions without departing from the spirit and scope of the invention as defined by the appended claims.

What is claimed is:

1. An automatic handrail tensioning system, comprising:

a sensor for detecting information that reflects a tension degree of the handrail;

a controller for determining tension degree information of the handrail according to the information detected by the sensor, and generating a corresponding control instruction for adjusting the tension degree of the handrail based on the tension degree information; and an actuator for driving a tensioning device to adjust the tension degree of the handrail based on the control instruction;

wherein the controller is configured to quantitatively determine the tension degree information of the handrail according to the information detected by the sensor, and to generate the corresponding control instruction for quantitatively adjusting the tension degree of the handrail based on quantitative tension degree information.

2. The automatic handrail tensioning system of claim 1, wherein the sensor comprises a pressure sensor, the information detected by the pressure sensor being a pressure value corresponding to a tension of the handrail.

3. The automatic handrail tensioning system of claim 2, wherein the pressure sensor comprises a first pressure sensor and/or a second pressure sensor; wherein the first pressure sensor is mounted between a first end revolution chain and a handrail guideway of the escalator, and/or the second pressure sensor is mounted between a second end revolution chain and the handrail guideway of the escalator.

4. The automatic handrail tensioning system of claim 2, wherein the pressure sensor comprises a first pressure sensor and/or a second pressure sensor; wherein the first pressure sensor is mounted on a bearing pedestal of a wheel of a first end revolution chain and/or the second pressure sensor is mounted on a bearing pedestal of a wheel of a second end revolution chain.

5. The automatic handrail tensioning system of claim 2, wherein the controller is further configured for: determining the tension degree information of the tension degree of the handrail being substantially normal when the pressure value is greater than or equal to a first predetermined pressure value and less than or equal to a second predetermined pressure value, determining the tension degree information of the tension degree of the handrail being too tight when the pressure value is greater than the second predetermined pressure value, and determining the tension degree information of the tension degree of the handrail being too loose when the pressure value is less than the first predetermined pressure value.

6. An escalator system comprising a handrail, further comprising the automatic handrail tensioning system of claim 1.

7. The automatic handrail tensioning system of claim 1, wherein the sensor comprises a temperature sensor for detecting temperature information of the handrail.

8. The automatic handrail tensioning system of claim 7, wherein the controller is further used to determine the tension degree information of the tension degree of the handrail being too tight when the temperature information is greater than or equal to a predetermined temperature threshold.

9. The automatic handrail tensioning system of claim 1, wherein the sensor comprises a ranging sensor for detecting spacing information between the handrail and a handrail guideway.

10. An automatic handrail tensioning system, comprising:

a sensor for detecting information that reflects a tension degree of the handrail;

a controller for determining tension degree information of the handrail according to the information detected by the sensor, and generating a corresponding control instruction for adjusting the tension degree of the handrail based on the tension degree information; and an actuator for driving a tensioning device to adjust the tension degree of the handrail based on the control instruction;

wherein the sensor comprises a ranging sensor for detecting spacing information between the handrail and a handrail guideway;

wherein the controller is further used to determine the tension degree information of the tension degree of the handrail being too tight when the spacing information is greater than or equal to a predetermined spacing threshold.

11. An automatic handrail tensioning system, comprising:

a sensor for detecting information that reflects a tension degree of the handrail;

a controller for determining tension degree information of the handrail according to the information detected by the sensor, and generating a corresponding control instruction for adjusting the tension degree of the handrail based on the tension degree information; and an actuator for driving a tensioning device to adjust the tension degree of the handrail based on the control instruction;

wherein the sensor comprises a ranging sensor for detecting spacing information between the handrail and a handrail guideway;

wherein the ranging sensor is mounted below the handrail corresponding to an upper corner part of the escalator.

12. An automatic handrail tensioning system, comprising:

a sensor for detecting information that reflects a tension degree of the handrail;

a controller for determining tension degree information of the handrail according to the information detected by the sensor, and generating a corresponding control instruction for adjusting the tension degree of the handrail based on the tension degree information; and an actuator for driving a tensioning device to adjust the tension degree of the handrail based on the control instruction;

wherein the sensor comprises a ranging sensor for detecting spacing information between the handrail and a handrail guideway;

wherein the tensioning device comprises:

a body;

wheels acting on an adjusted handrail;

main screw rod substantially perpendicular to the adjusted handrail;

an upper platen;

a lower platen substantially parallel to the upper platen; and a compression elastomer between the upper platen and the lower platen;

wherein the main screw rod is connected with a output end of the actuator, when the main screw rod is driven by the actuator to rotate in a first direction/second direction, the upper platen is driven to move upwards/downwards along the main screw rod, thus the lower platen is driven by the compression elastomer to move upwards/downwards, and the lower platen drives the wheel to release/increase the tension of the handrail.

13. The automatic handrail tensioning system of claim 12, further comprising: a pair of linear guides secured on the body and substantially perpendicular to the adjusted handrail, wherein the main screw rod is positioned between the pair of linear guides, the lower platen being movable upwards/downwards along the pair of linear guides.

14. The automatic handrail tensioning system of claim 12, further comprising a fixed bracket secured on the body for securing a lower end of the main screw rod and the actuator.

15. The automatic handrail tensioning system of claim 12, wherein the sensor comprises a pressure sensor, the information detected by the pressure sensor being a pressure value corresponding to a tension of the handrail;

wherein the pressure sensor is mounted between the upper platen and the lower platen to detect a pressure value produced by the compression elastomer.

16. A method for adjusting a tension degree of a handrail, the method comprising:

detecting information that reflects the tension degree of the handrail;

determining tension degree information of the handrail according to the detected information;

generating a corresponding control instruction for adjusting the tension degree of the handrail based on the tension degree information; and driving a tensioning device to adjust the tension degree of the handrail based on the control instruction;

wherein determining the tension degree information includes quantitatively determining quantitative tension degree information of the handrail according to the detected information;

wherein generating the corresponding control instruction includes generating the corresponding control instruction for quantitatively adjusting the tension degree of the handrail based on the quantitative tension degree information.

17. The method of claim 16, wherein the detected information comprises a pressure value corresponding to a tension of the handrail.

18. The method of claim 17, wherein determining the tension degree information includes:

determining the tension degree information of the tension degree of the handrail being substantially normal when the pressure value is greater than or equal to a first predetermined pressure value and less than or equal to a second predetermined pressure value, determining the tension degree information of the tension degree of the handrail being too tight when the pressure value is greater than the second predetermined pressure value, and determining the tension degree information of the tension degree of the handrail being too loose when the pressure value is less than the first predetermined pressure value.

19. The method of claim 16, wherein the detected information comprises temperature information of the handrail;

wherein determining the tension degree information includes determining the tension degree information of the tension degree of the handrail being too tight when the temperature information is greater than or equal to a predetermined temperature threshold.

20. A method for adjusting a tension degree of a handrail, the method comprising:

detecting information that reflects the tension degree of the handrail;

determining tension degree information of the handrail according to the detected information;

generating a corresponding control instruction for adjusting the tension degree of the handrail based on the tension degree information; and driving a tensioning device to adjust the tension degree of the handrail based on the control instruction;

wherein the detected information comprises spacing information between the handrail and a handrail guideway;

wherein determining the tension degree information includes determining the tension degree information of the tension degree of the handrail being too tight when the spacing information is greater than or equal to a predetermined spacing threshold.

* * * * *